US010794563B2

(12) United States Patent
Zhan et al.

(10) Patent No.: US 10,794,563 B2
(45) Date of Patent: Oct. 6, 2020

(54) ILLUMINATION DEVICE

(71) Applicant: OPPLE LIGHTING CO., LTD., Shanghai (CN)

(72) Inventors: Gongpu Zhan, Shanghai (CN); Song Yin, Shanghai (CN); Ming Chen, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/379,601

(22) Filed: Apr. 9, 2019

(65) Prior Publication Data

US 2019/0234577 A1 Aug. 1, 2019

Related U.S. Application Data

(63) Continuation of application No. PCT/CN2017/105742, filed on Oct. 11, 2017.

(30) Foreign Application Priority Data

Oct. 17, 2016 (CN) ..... 2016 1 0902853
Oct. 17, 2016 (CN) ..... 2016 2 1128906 U

(51) Int. Cl.
*F21V 21/04* (2006.01)
*F21S 8/04* (2006.01)
(Continued)

(52) U.S. Cl.
CPC ..... *F21S 41/657* (2018.01); *F21S 8/04* (2013.01); *F21V 7/0016* (2013.01); *F21V 13/04* (2013.01);
(Continued)

(58) Field of Classification Search
CPC ..... F21V 5/04; F21V 7/0016; F21V 13/04; F21V 21/04; F21V 23/003; F21S 8/04; F21S 8/00; F21S 41/657
See application file for complete search history.

(56) References Cited

U.S. PATENT DOCUMENTS 3,278,203 A * 10/1966 Gerson Snyder ..... F21V 21/30 285/138.1
5,086,379 A * 2/1992 Denison ..... F21S 8/081 248/289.11
(Continued)

FOREIGN PATENT DOCUMENTS

CN 103851364 A 6/2014
CN 104315424 A 1/2015
(Continued)

OTHER PUBLICATIONS

International Search Report (including English translation) and Written Opinion issued in PCT/CN2017/105742, dated Jan. 17, 2018, 10 pages.

*Primary Examiner* — Arman B Fallahkhair
(74) *Attorney, Agent, or Firm* — Arch & Lake LLP

(57) ABSTRACT

The present disclosure discloses an illumination device, including a first lamp body; a driving power supply component received in the first lamp body; a connecting element assembled into the first lamp body; a second lamp body connected to the connecting element and rotatable with respect to the first lamp body; a light source component received in the second lamp body; a second light distribution element received in the second lamp body and configured to perform a secondary light distribution to a part of light emitted from the light source component; and a first light distribution element disposed on the first lamp body and
(Continued)

configured to perform a secondary light distribution to a second part of the light emitted from the light source component.

15 Claims, 6 Drawing Sheets

(51) Int. Cl.

| | |
|---|---|
| ***F21S 41/657*** | (2018.01) |
| ***F21V 13/04*** | (2006.01) |
| ***F21V 7/00*** | (2006.01) |
| ***F21V 23/00*** | (2015.01) |
| *F21Y 115/10* | (2016.01) |

(52) U.S. Cl.
CPC ..... *F21V 21/04* (2013.01); *F21V 23/003* (2013.01); *F21Y 2115/10* (2016.08)

(56) References Cited

U.S. PATENT DOCUMENTS

| | | | | |
|---|---|---|---|---|
| 5,335,159 | A * | 8/1994 | Chen | F21V 21/30 362/147 |
| 5,738,436 | A * | 4/1998 | Cummings | F21S 8/026 362/294 |
| 7,390,110 | B2 * | 6/2008 | Katz | F21V 21/30 362/382 |
| 8,414,164 | B2 * | 4/2013 | Ogawa | F21S 8/043 362/373 |
| 8,545,055 | B2 * | 10/2013 | Chang | A47G 23/0216 362/249.03 |
| 9,347,655 | B2 * | 5/2016 | Boomgaarden | F21V 21/30 |
| 9,353,935 | B2 * | 5/2016 | Holland | F21V 21/15 |
| 9,857,069 | B2 * | 1/2018 | Kim | F21S 8/063 |
| 2013/0107517 | A1 | 5/2013 | Shih | |
| 2017/0184285 | A1 * | 6/2017 | Visser | F21V 21/047 |
| 2019/0234569 | A1 * | 8/2019 | Zhan | F21V 21/29 |

FOREIGN PATENT DOCUMENTS

| | | |
|---|---|---|
| CN | 205351023 U | 6/2016 |
| CN | 106439616 A | 2/2017 |
| CN | 206072896 U | 4/2017 |

* cited by examiner

ILLUMINATION DEVICE

CROSS-REFERENCE TO RELATED APPLICATIONS

This application is based upon and claims the priority of PCT patent application No. PCT/CN2017/105742 filed on Oct. 11, 2017 which claims the priority of Chinese Patent Application No. 201610902853.3 filed on Oct. 17, 2016 and Chinese Patent Application No. 201621128906.2 filed on Oct. 17, 2016, the entire content of all of which is hereby incorporated by reference herein for all purposes.

TECHNICAL FIELD

The present disclosure relates to the field of illumination technologies, and particularly relates to an illumination device.

BACKGROUND

With the rapid development of semi-illumination technologies, people's demands on illumination devices are higher and higher. According to an illuminating angle, a ceiling lamp may be a downlight or a spotlight. As an illuminator which is embedded in a ceiling and emits downward light rays, the downlight has the advantage of keeping uniform and perfection architectural ornament, and the artwork on the ceiling may not be affected by the arrangement of lamps. On the other hand, light rays from the spotlight directly illuminate on household objects to be highlighted, so as to emphasize subjective aesthetic sense and achieve art effects of highlighted key points, unique environments, rich layers and atmosphere, and plentiful colors. The spotlight may have soft light rays, and is both dignified and graceful, which not only dominates the whole illumination, but also enables the local lighting and heightens atmosphere inside the house.

SUMMARY

The present disclosure provides an illumination device and a method of manufacturing an illumination device.

According to a first aspect, an illumination device is provided. The illumination device may include: a first lamp body; a driving power supply component received in the first lamp body; a connecting element assembled into the first lamp body; a second lamp body connected to the connecting element and that is rotatable with respect to the first lamp body; a light source component received in the second lamp body; a second light distribution element received in the second lamp body that is configured to perform a secondary light distribution to a part of light emitted from the light source component; and a first light distribution element disposed on the first lamp body that is configured to perform a secondary light distribution to the other part of the light emitted from the light source component.

According to a second aspect, a method of manufacturing an illumination device is provided. The method may include providing a first lamp body; providing a driving power supply component received in the first lamp body; assembling a connecting element into the first lamp body; connecting a second lamp body to the connecting element that is rotatable with respect to the first lamp body; providing a light source component received in the second lamp body; providing a second light distribution element received in the second lamp body that is configured to perform a secondary light distribution to a part of light emitted from the light source component; and disposing a first light distribution element on the first lamp body that is configured to perform a secondary light distribution to a second part of the light emitted from the light source component.

It is to be understood that both the foregoing general description and the following detailed description are exemplary and explanatory only and are not restrictive of the present disclosure

BRIEF DESCRIPTION OF THE DRAWINGS

In order to clearly illustrate the technical solution of the examples of the disclosure or the technical solution of conventional technologies, the drawings of the examples or the drawings of the conventional technologies will be briefly described in the following; it is obvious that the described drawings are only related to some examples of the disclosure. For those skilled in the art, other drawings can be obtained according to these drawings, without any inventive work.

DETAILED DESCRIPTION

Figure 1:
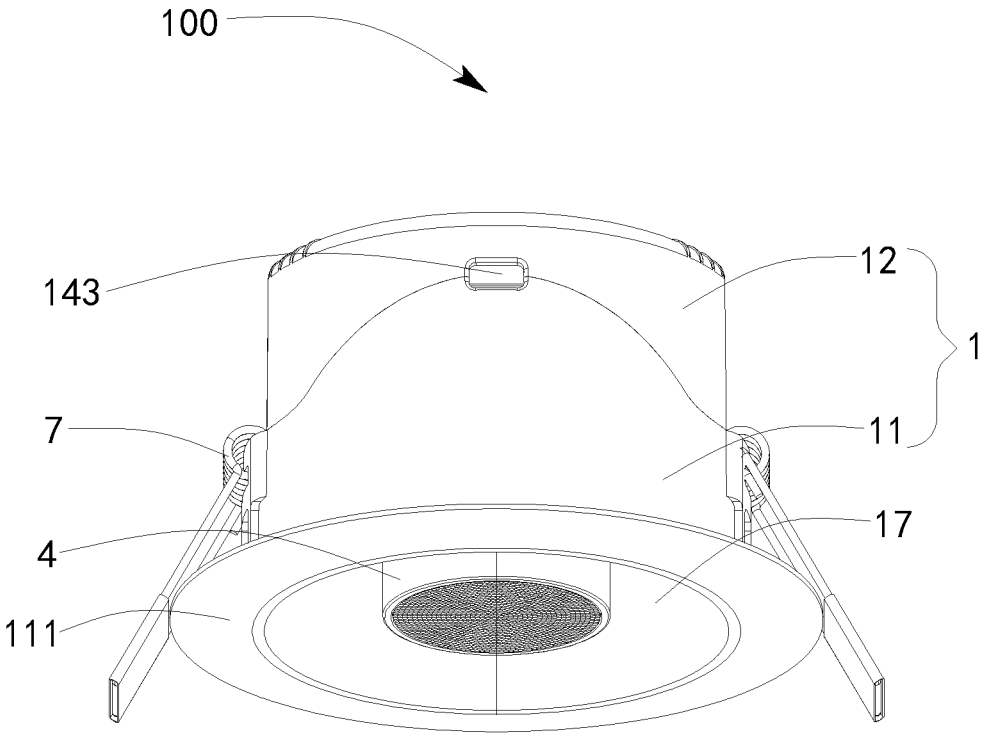
FIG. 1 is a schematic view of an illumination device provided by the present disclosure.

In order to make objects, technical solutions and advantages of the disclosure apparent, the technical solutions of the disclosure will be described in a clearly and fully understandable way in connection with examples and related drawings in the following. Apparently, the described examples are just a part but not all of the examples of the disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals shown in FIG. 1 to FIG. 9 are: illumination device 100, first lamp body 1, first cover 11, main body part 110, edge part 111, second cover 12, circular top wall 121, annular side wall 122, concave part 123, connecting part 124, protrusion 125, inserting part 126, groove 127, third through hole 128, third opening 129, receiving cavity 13, convex part 14, first through hole 141, first opening 142, elongated hole 143, fastener 15, mounting part 16, through hole 161, first hole part 161*a*, second hole part 161*b*, first positioning column 162, first screw hole 163, second positioning column 164, second screw hole 165, reflector 17, reflecting surface 171, first arc surface 172, second arc surface 173, driving power supply component 2, power supply substrate 21, sixth through hole 22, connecting element 3, first connecting part 31, spherical hole 311, pressing plate part 32, eighth through hole 321, seventh through hole 33, fixing groove 34, second lamp body 4, receiving groove 40, partition plate 41, lamp-body side wall 42, annular groove 43, fourth through hole 431, boss 44, connecting rod 45, second connecting part 46, fifth through hole 47, protection cover 48, light source component 5, light source substrate 51, first light-emitting unit 52, second light-emitting unit 53, second light distribution element 6, housing 61, clamp spring 7, first screw 81, and second screw 82.

In the event that both downlight and spotlight are required, the mounting process is complicated and the cost is expensive because a large number of lamp bodies are mounted on a wall or ceiling. Also, after fixedly mounting the existing downlight and spotlight, the illuminating angle cannot be adjusted in most cases. For some spotlights, the illuminating angle may be adjusted, but their structures are complicated and difficult to manufacture, which makes it difficult to meet usage requirements. An example of the present disclosure provides an illumination device 100 which integrates a function of the downlight with a function of the spotlight. Please refer to FIG. 1 to FIG. 9 for details.

As illustrated in FIG. 1 to FIG. 9, the illumination device 100 includes a first lamp body 1, a driving power supply component 2 received in the first lamp body 1, a connecting element 3 assembled in the first lamp body 1, a second lamp body 4 which is connected with the connecting element 3 and is rotatable with respect to the first lamp body 1, a light source component 5 received in the second lamp body 4, a second light distribution element 6 which is received in the second lamp body 4 and presses against the light source component 5, and a clamp spring 7 mounted outside the first lamp body 1. The illumination device 100 described above can be an embedded LED downlight, or a spotlight, or a tube spotlight for indoor illumination. It should be noted that, in other alternative examples, the driving power supply component 2 may not be disposed inside the first lamp body 1 of the illumination device 100, but is disposed outside the illumination device 100.

Various components and the connecting relationship between the components in the illumination device 100 provided by the example of the present disclosure will be described below in more details.

As illustrated in FIG. 1 to FIG. 5, the first lamp body 1 includes a first cover 11 and a second cover 12 connected with the first cover 11. Further, the first lamp body 1 is provided with a receiving cavity 13. After the first cover 11 and the second cover 12 are assembled together, the receiving cavity 13 is delimited by both of the first cover 11 and the second cover 12.

As illustrated in FIG. 3 to FIG. 7, the first cover 11 is substantially cylindrical, and can be formed of a plastic material or a metal material. Specifically, the first cover 11 includes: an integrally formed, main body part 110; an edge part 111 which is disposed at a lower end surface of the main body part 110 and has a horizontal annular shape; a first light distribution element 17 which is located at an inner side of the main body part 110 and is connected with the main body part 110; and a mounting part 16 which is located inside the main body part 110 and is surrounded by the first light distribution element 17. In other alternative examples, it's also possible that the edge part 111 and the first light distribution element 17 are integrally formed as the mounting part 16, which is then connected with the main body part 110.

Structures of various parts of the first cover 11 will be particularly described below.

The edge part 111 of the first cover 11 can be directly abutted against an outer surface of a mounting base (not illustrated), when mounting the illumination device 100. Two sides of an upper end surface of the main body part 110 of the first cover 11 are respectively provided with an upwardly extending convex part 14. Specifically, one of the two convex parts 14 is provided with a strip-shaped positioning hole 141, and the other one of the two convex parts 14 is provided with a strip-shaped first opening 142. The main body part 110 of the first cover 11 is provided with two second openings (not illustrated) which are in an inverted T shape and pass through the main body part 110; in this way, the main body part 110 is formed with a fastener 15 for mounting the clamp spring 7.

As illustrated in FIG. 1 to FIG. 4, FIG. 6 and FIG. 7, the first light distribution element 17 is disposed at the inner side of the main body part 110, and has one end connected with an inner surface of the first cover 11 and the other end connected with the mounting part 16. In the present example, the first light distribution element 17 is preferably a reflector. The first light distribution element 17 has a reflecting surface 171 for performing a secondary light distribution on a part of light emitted from the light source unit 5, i.e., reflecting the light. The first light distribution element 17 can be formed of a plastic material having an optical property such as polycarbonate (PC). A surface of the first light distribution element 17 that faces the light source component 5 is coated with a reflective layer to form the reflecting surface 171. The first light distribution element 17 reflects a part of the light emitted from the light source component 5 to be used for flood lighting of the illumination device 100 at a large angle, so that the illumination device 100 functions as a downlight.

Figure 2:
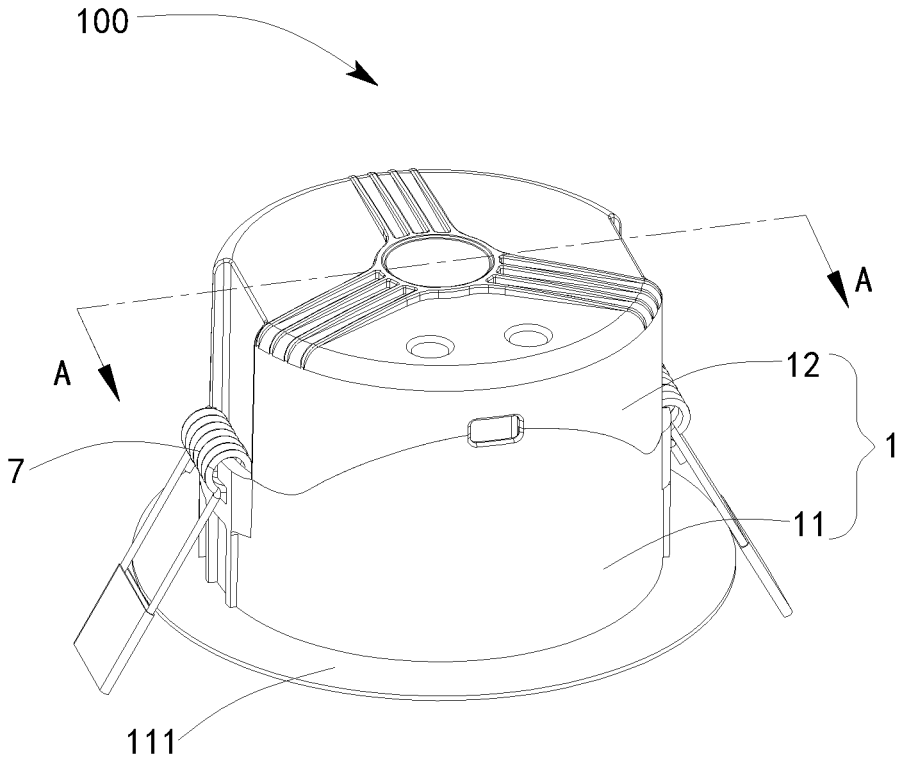
FIG. 2 is a schematic view in another direction of the illumination device provided by the present disclosure.
Figure 3:
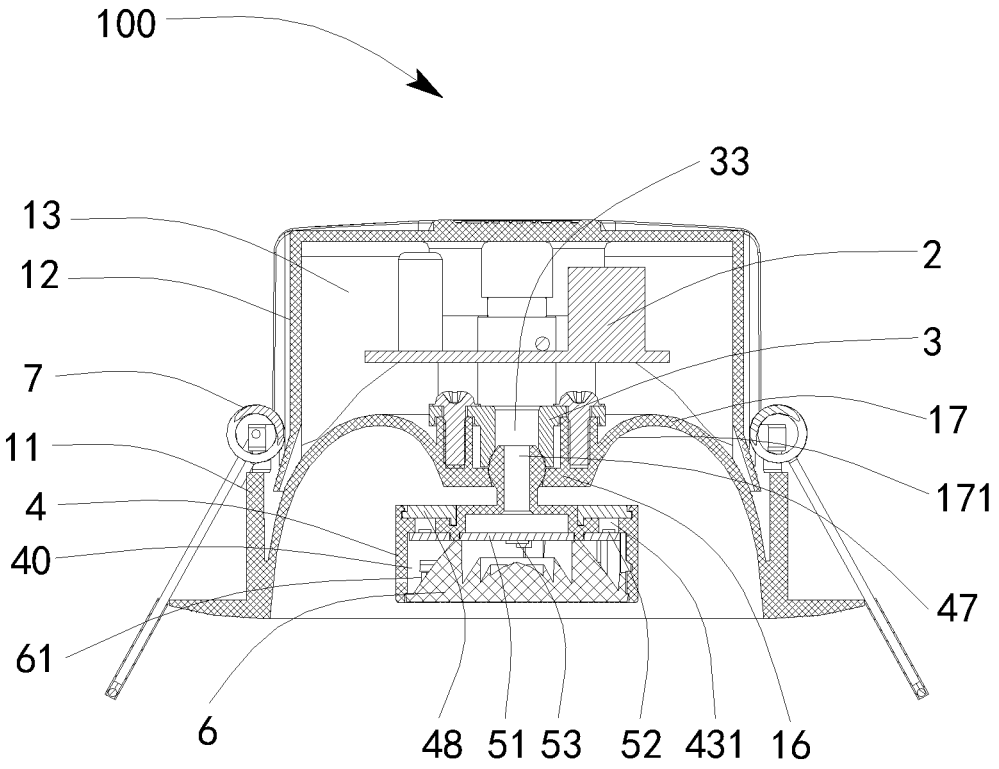
FIG. 3 is a sectional view taken along an A-A direction in FIG. 2.
Figure 6:
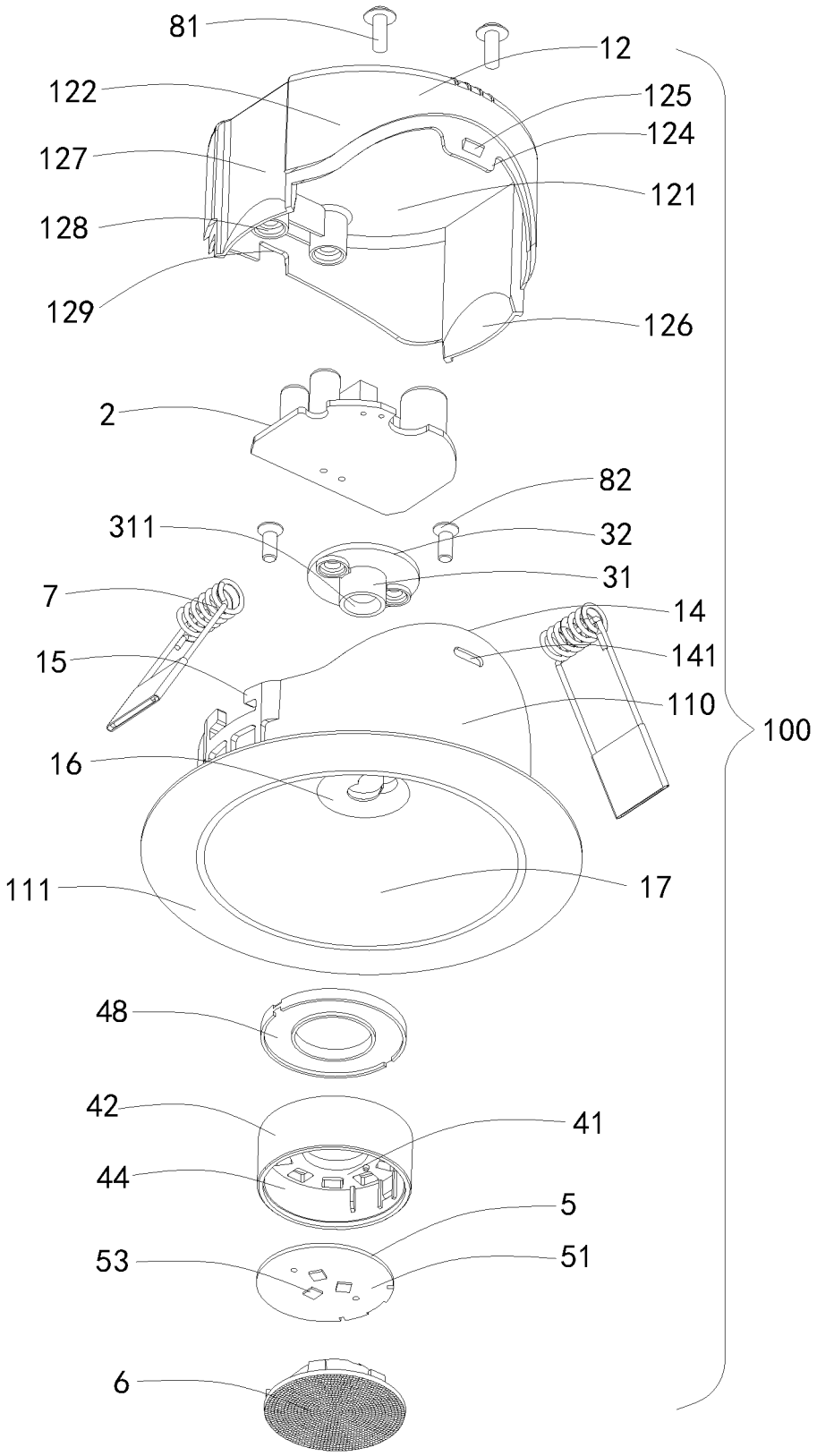
FIG. 6 is an exploded view in another direction of the illumination device provided by the present disclosure.

As illustrated in FIG. 2, FIG. 3 and FIG. 6, the first light distribution element 17 has an annular shape in a horizontal direction and has a curved-surface shape in a vertical direction. Specifically, the first light distribution element 17, that is, the reflector, has two J-shaped surfaces in a cross section in the vertical direction, including a first arc surface 172 and a second arc surface 173 which are opposite to each other. When the first cover 11, a plurality of first light-emitting units 52 and a plurality of second light-emitting units 53 are projected onto a plane in the horizontal direction, projections of the plurality of first light-emitting units 52 fall within a range of a projection of the first light distribution element 17, and projections of the plurality of second light-emitting units 53 fall within a range of a projection of the mounting part 16.

Figure 5:
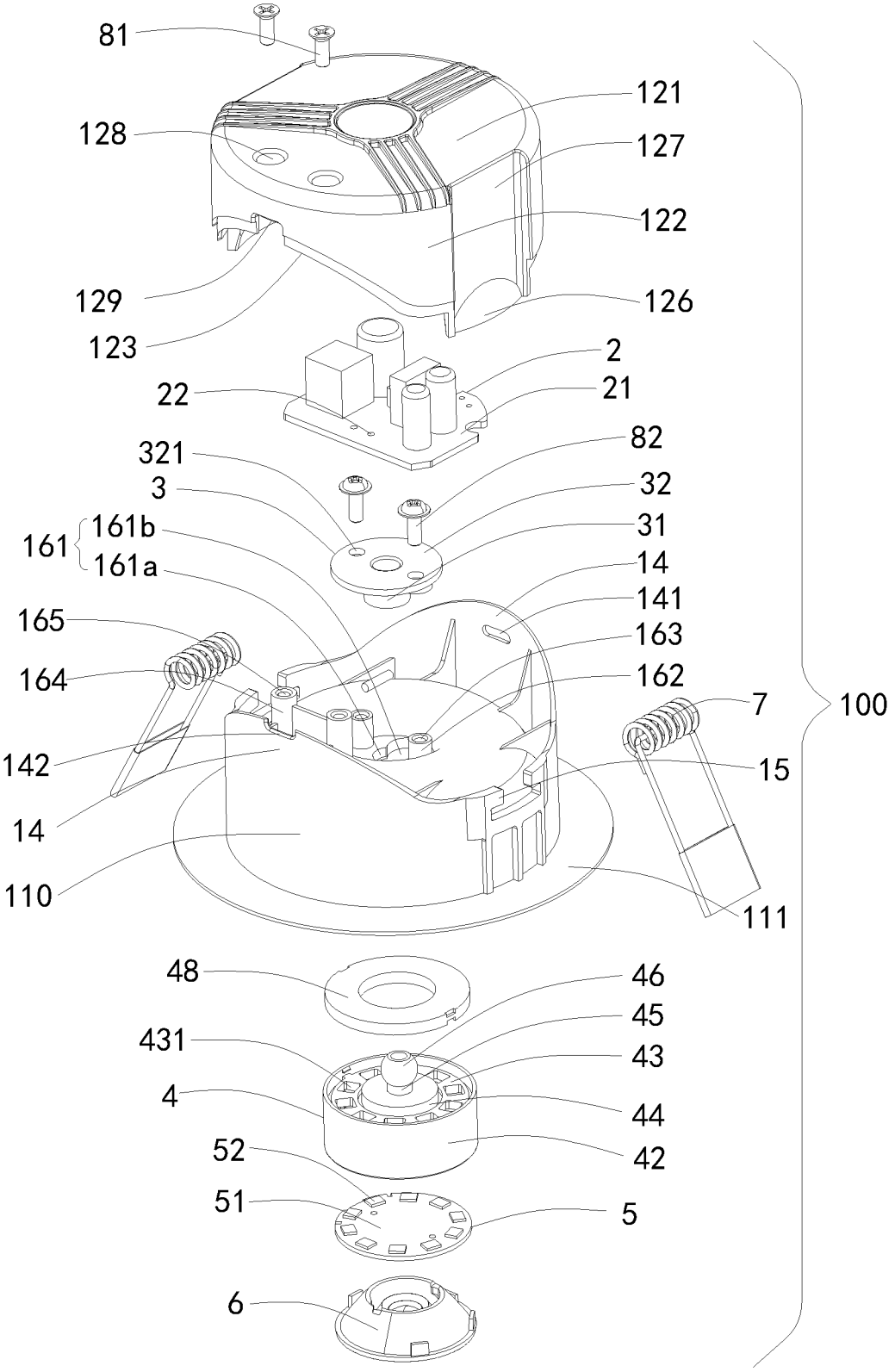
FIG. 5 is an exploded view in one direction of the illumination device provided by the present disclosure.
Figure 7:
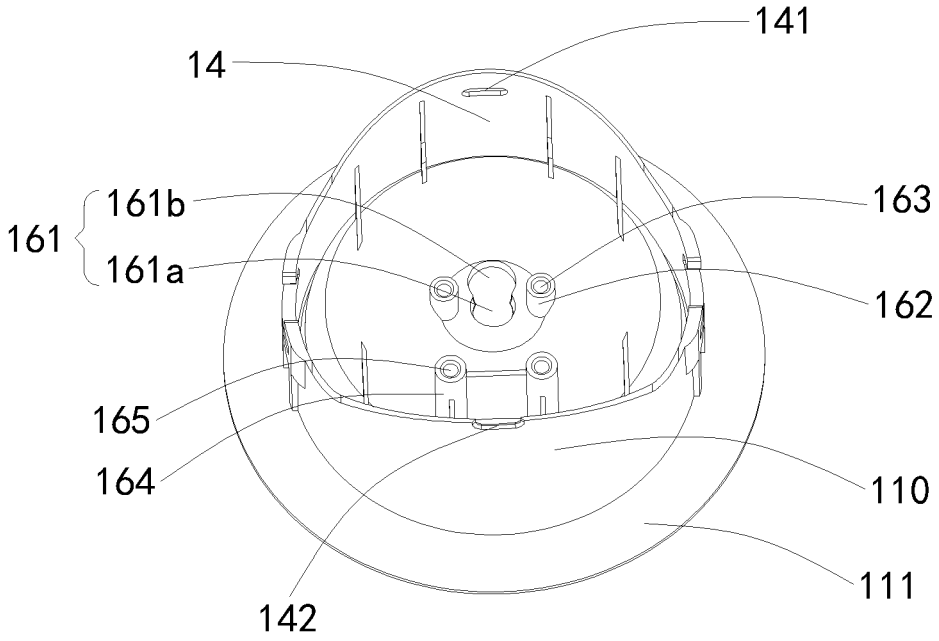
FIG. 7 is a schematic view of a first cover of the illumination device provided by the present disclosure.

As illustrated in FIG. 5 to FIG. 7, the mounting part 16 is provided with a through hole 161 which is in a shape of figure-of-8, and the through hole 161 includes a first hole part 161*a* and a second hole part 161*b* connected with the first hole part 161*a*. Specifically, an inner diameter of the second hole part 161*b* is greater than an inner diameter of the first hole part 161*a*, the first hole part 161*a* is a spherical hole and a center line of the first hole part 161*a* is coincident with a center line of the first cover 11. The mounting part 16 is further provided with two cylindrical first positioning columns 162, and the two first positioning columns 162 are located at two sides of the first hole part 161*a*, respectively. A first screw hole 163 is disposed in each of the first positioning columns 162. Additionally, the mounting part 16 is further provided with two second positioning columns 164, and a second screw hole 165 is disposed in each of the second positioning columns 164.

As illustrated in FIG. 1 to FIG. 6, the second cover 12 is integrally formed of a plastic material and is substantially cylindrical, and the second cover 12 is connected with an end of the main body part 110 in a clamping manner to form the first lamp body 1. Specifically, the second cover 12 includes a circular top wall 121 and an annular side wall 122 which extends downwards from the circular top wall 121. An end of the annular side wall 122 is provided with two concave parts 123 which are matched with the two convex parts 14, respectively. One of the concave parts 123 is provided with a connecting part 124 extending outwards, the connecting part 124 is provided with an outward protrusion 125 matched with the first through hole 141, and the protrusion 125 is a wedge block. The other one of the two concave parts 123 is provided with a third opening 129 corresponding to the first opening 142. The first opening 142 and the third opening 129 are matched with each other to form an elongated hole 143 through which a power line (not illustrated) can pass.

Referring to FIG. 5 and FIG. 6, a middle portion between the two concave parts 123 extends downwards along an axial direction of the second cover 12 to form an inserting part 126. Two sides of the first lamp body 1 each are provided with a groove 127 along the axial direction of the first lamp body 1, and the groove 127 communicates the interesting part 126 with the annular side wall 122. The first cover 11 and the second cover 12 are fixedly connected together by means of the first through hole 141 matching with the protrusion 125. The circular top wall 121 is provided with two third through holes 128 respectively corresponding to the second screw hole 165, and the second cover 12 and the first cover 11 are locked with each other through the second screws 82 disposed in the third through hole 128 and in the second screw hole 165. In other alternative examples, the first cover 11 and the second cover 12 may be connected with each other by bonding or in a clamping manner, or by other ways, which are not particularly described herein.

As illustrated in FIG. 1 to FIG. 4, two clamp springs 7 can be rotatably sleeved on two fasteners 15, respectively. By means of the clamp springs 7, the illumination device 100 may be mounted on the mounting base. The groove 127 is used for reserving a space for dismounting and rotating the clamp springs 7 conveniently. Of course, in other alternative examples of the present disclosure, the clamp spring 7 may be mounted on a card (not illustrated) in advance, and then the card is mounted onto the second cover 12 or the first cover 11 by bonding or by using a screw. By means of the first cover 11 and the clamp spring 7, the illumination device 100 may be mounted on the mounting base, for example, a building wall or a ceiling or the like.

As illustrated in FIG. 3, FIG. 5 and FIG. 7, the connecting element 3 includes a tubular first connecting part 31 and a pressing plate part 32 which extends from an end of the first connecting part 31 towards a periphery of the first connecting part 31, and the connecting element 3 is locked with the first cover 11 through a first screw 81. A bottom of the first connecting part 31 is provided with a spherical hole 311 corresponding to the first hole part 161*a*, and the spherical hole 311 is combined with the first hole part 161*a* to form a fixing groove 34. The pressing plate part 32 is provided with an eighth through hole 321 corresponding to the first screw hole 163. The connecting element 3 is locked on the mounting part 16 by means of the first screw 81 which passes through the eighth through hole 321 and is received in the first screw hole 163.

Figure 4:
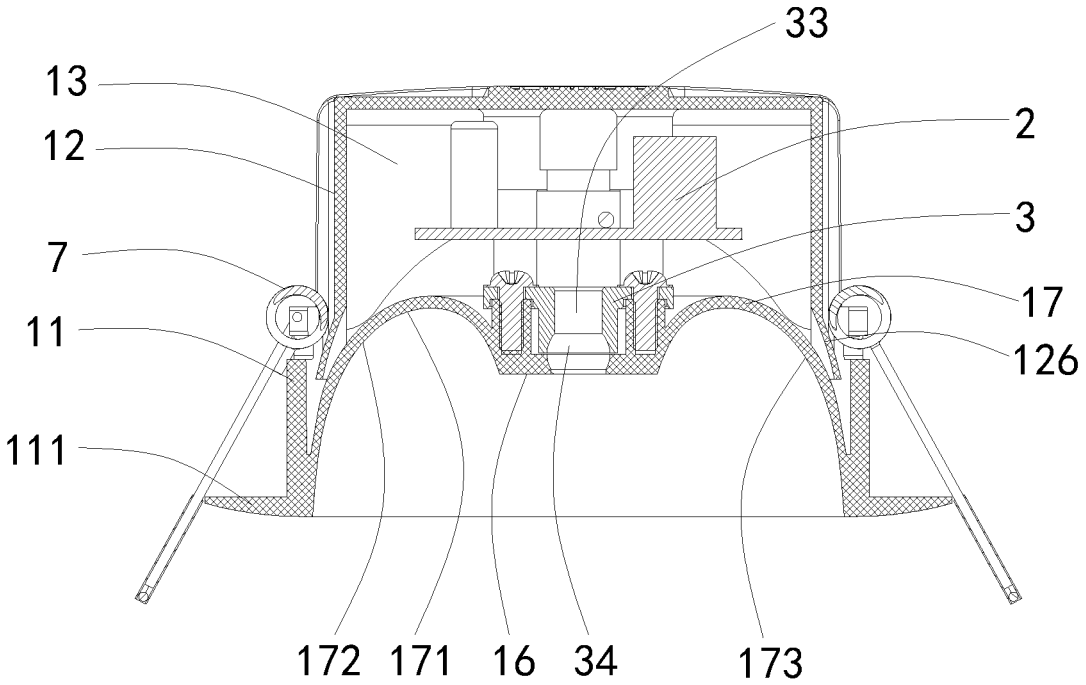
FIG. 4 is a schematic view illustrating a state where a second lamp body and a light source component in FIG. 3 are removed.

As illustrated in FIG. 3 to FIG. 5, the second lamp body 4 includes a tubular lamp-body side wall 42 and a partition plate 41 disposed in the lamp-body side wall 42. A position where the first lamp body 1 is connected with the second lamp body 4 is located at a middle part of the first light distribution element 17, i.e., a middle part of the reflector. A bottom of the reflector is located between a bottom of the first lamp body 1 and the position where the first lamp body 1 is connected with the second lamp body 4. Further, a receiving groove 40 is delimited by an inner surface of the lamp-body side wall 42 and a lower surface of the partition plate 41. A boss 44 is provided at a middle part of an upper surface of the partition plate 41, and an annular groove 43 is formed between the boss 44 and the lamp-body side wall 42. The boss 44 is connected, through a connecting rod 45, with a spherical second connecting part 46 which is matched with the fixing groove 34. The second connecting part 46 is rotatable in the fixing groove 34 under an action of an external force, thereby adjusting an angle of the second lamp body 4. In mounting, the second connecting part 46 passes through the second hole part 161*b*, and then moves from a position where the connecting rod 45 is located to the first hole part 161*a*, and then the connecting element 3 is locked onto the mounting part 16 by means of the first screws 81.

As illustrated in FIG. 3 to FIG. 5, the partition plate 41 is provided with a plurality of fourth through holes 431. The fourth through hole 431 penetrates the upper surface and the lower surface of the partition plate 41, and is communicated with the annular groove 43 so as to allow light to pass there-through. The second lamp body 4 is provided with a fifth through hole 47, the fifth through hole 47 penetrates the partition plate 41, the boss 44, the connecting rod 45 and the second connecting part 46 so as to allow a conductive wire to pass there-through. The second lamp body 4 is a plastic lamp body, and may be formed by a single injection molding process, which achieves convenient production and low costs. Of course, in order to enhance the heat dissipation effect of the illumination device 100, the second lamp body 4 may alternatively be formed of a thermal conductive metal material such as aluminum.

The annular groove 43 is provided with a protective cover 48 which is formed of a transparent insulation material, so as to allow the light emitted from the light source component 5 to pass there-through. The transparent insulation material may be an insulation material such as PMMA (polymethyl methacrylate), polycarbonate (PC), polystyrene (PS), polyester resin (PET) and polyethylene terephthalate glycol (PETG). The arrangement of the protective cover 48 allows a distance between the light source component 5 and the driving power supply component 2 to meet regulations related to a safe creep distance.

Figure 8:
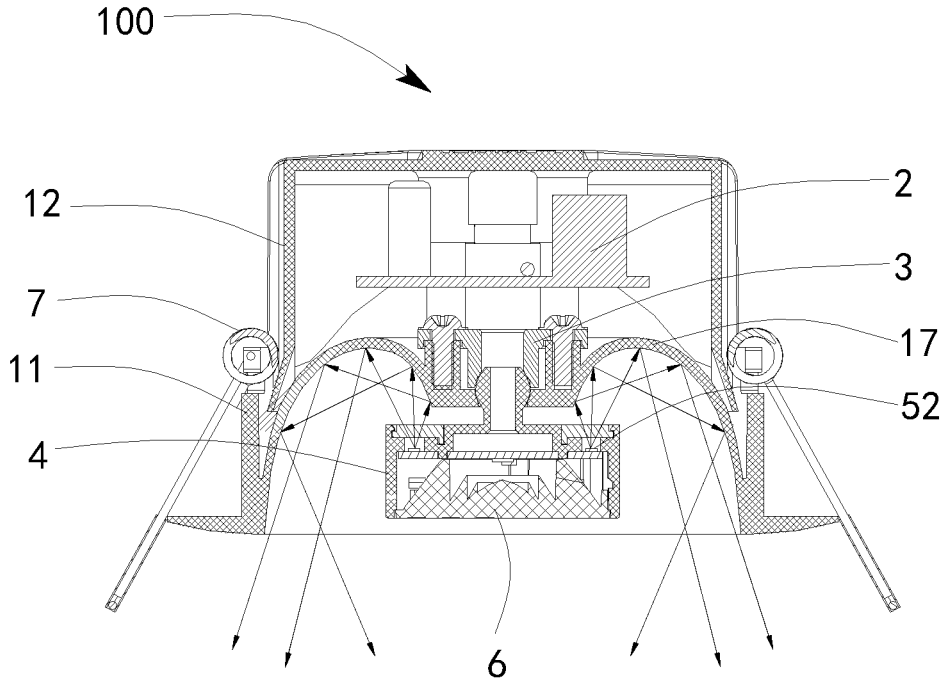
FIG. 8 illustrates an optical path in a light-emitting state of a first light-emitting unit of the illumination device provided by the present disclosure.
Figure 9:
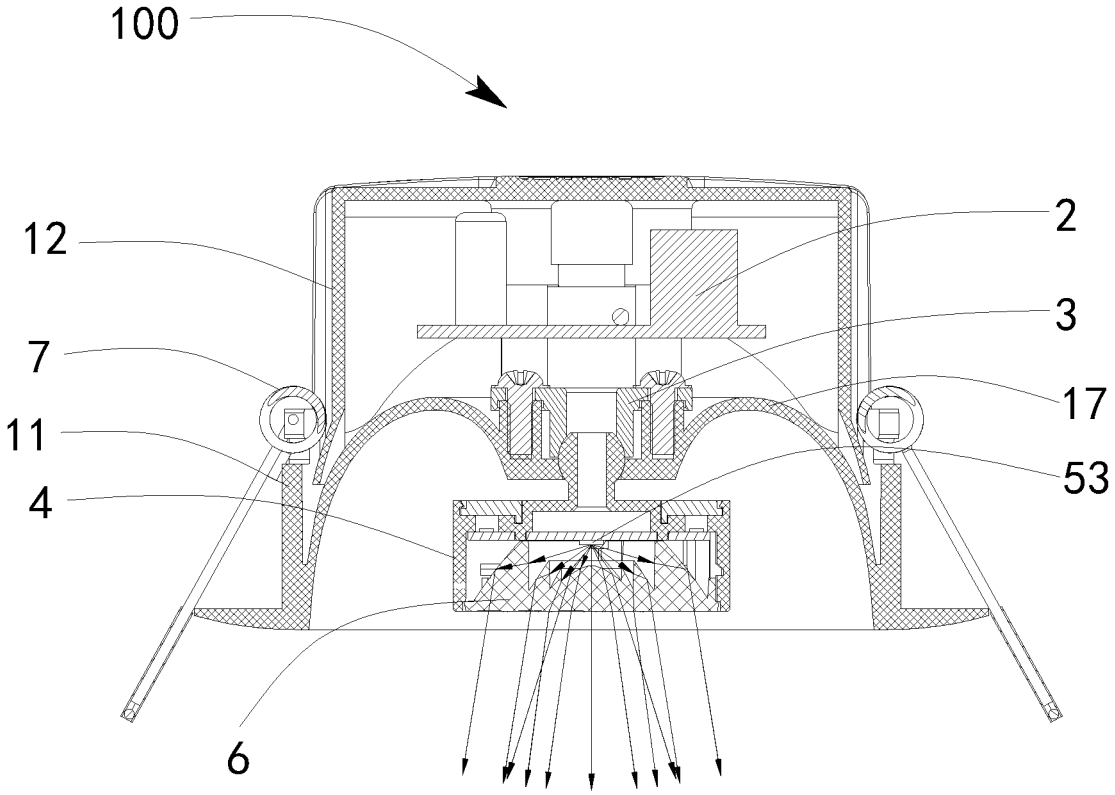
FIG. 9 illustrates an optical path in a light-emitting state of a second light-emitting unit of the illumination device provided by the present disclosure.

As illustrated in FIG. 8 and FIG. 9, the light source component 5 is received in the receiving groove 40, and the light source component 5 includes a light source substrate 51, a plurality of first light-emitting units 52 disposed on a surface of the light source substrate 51, and a plurality of second light-emitting units 53 disposed on the other surface of the light source substrate 51. The plurality of second light-emitting units 53 may emit light towards an opening of the second lamp body 4, and the plurality of first light-emitting units 52 may emit light in a direction opposite to the direction of the light emitted from the second light-emitting units 53.

Preferably, the plurality of first light-emitting units 52 and the plurality of second light-emitting units 53 are LED light sources. The plurality of first light-emitting units 52 and the second light-emitting units 53 may be electrically connected onto the light source substrate 51 by using through hole technology (THT) or surface mount technology (SMT). The light source substrate 51 may be a printed circuit board, and the printed circuit board is attached with conducting circuits (not illustrated). With the above-mentioned conducting circuits, the plurality of first light-emitting units 52 may be electrically connected, the plurality of second light-emitting units 53 may be electrically connected, or the plurality of first light-emitting units 52 and the plurality of second light-emitting units 53 may be electrically connected.

As illustrated in FIG. 3 and FIG. 5 to FIG. 9, particularly, the plurality of first light-emitting units 53 are arranged in a circumferential direction of the light source substrate 51 and are disposed in one-to-one correspondence with the plurality of fourth through holes 431. In this way, the light emitted from the plurality of first light-emitting units 53 may pass through the corresponding fourth through holes 431 respectively, and then illuminates onto the reflecting surface 171 of the reflector 17, and then exits after being reflected by the reflector 17. The second light-emitting units 52 are located in a central area of the light source substrate 51. The second light distribution element 6 is located in the receiving groove 40, and the second light distribution element 6 is configured to adjust an optical path of the light emitted from the second light-emitting units 53, i.e., light distribution, such as light condensation and light diffusion. In the present disclosure, preferably, a condensation and collimation lens is used as the second light distribution element 6. In a situation where the second light-emitting units 53 emit light, the second light distribution element 6 has a function of light condensation so as to be used for small-angle accent lighting. In this way, the illumination device 100 functions as the spotlight.

As illustrated in FIG. 3 to FIG. 6, the driving power supply component 2 is received in the receiving cavity 13, and includes a power supply substrate 21 and an LED driving power supply (not illustrated) disposed at a side of the power supply substrate 21. The plurality of first light-emitting units 52 and the plurality of light-emitting units 53 as well as the driving power supply component 2 are located at two sides of the first light distribution element 17 respectively. The LED driving power supply is connected with the light source substrate 51 through a conductive wire (not illustrated). The power supply substrate 21 is further provided with a controller (not illustrated), and the controller includes a timer, a switch (not illustrated) for controlling the first light-emitting unit 52 and the second light-emitting unit 53 respectively, and a signal receiver for receiving a signal from a remote controller or a control terminal. Specifically, after the signal receiver receives the signal, the controller controls the first light-emitting unit 52 or the second light-emitting unit 53 to turn on or turn off, or controls the first light-emitting unit 52 and the second light-emitting unit 53 to be switched; moreover, the first light-emitting unit 52 and the second light-emitting unit 53 may also be switched periodically by using the timer.

The LED driving power supply includes a plurality of components and elements, including but not limited to an LED driving controller chip, a rectification chip, a resistor, a capacitor, a fuse wire, a coil, or the like. The power supply substrate 21 is further provided with a plurality of sixth through holes 22, through which screws can pass so as to fix the power supply substrate 21 onto the second cover 12 or the first cover 11. The number of the sixth through holes 22 is at least two. The at least two sixth through holes 22 may be located at an edge of the power supply substrate 21, for avoiding interference with components and elements on the power supply substrate 21.

Compared with the other designs, in the illumination device provided by the present disclosure, the first light-emitting units are used for wide-angle floodlighting so that the illumination device can serve as a downlight, while the second light-emitting units are used for small-angle accent lighting so that the illumination device can serve as a spotlight. The illumination device provided by the present disclosure integrates the downlight with the spotlight, which allows for a simpler structure and a convenient usage. In mounting and using, the angle of the second lamp body may be adjusted according to illumination requirements, which is convenient.

The present disclosure provides an illumination device with a simple structure, which may adjust the illuminating angle and realize different illumination effects.

The present disclosure provides an illumination device, including: a first lamp body; a driving power supply component received in the first lamp body; a connecting element assembled into the first lamp body; a second lamp body connected to the connecting element and rotatable with respect to the first lamp body; a light source component received in the second lamp body; a second light distribution element received in the second lamp body and configured to perform a secondary light distribution to a part of light emitted from the light source component; and a first light distribution element disposed on the first lamp body and configured to perform a secondary light distribution to the other part of the light emitted from the light source component.

Further, a mounting part is disposed inside the first lamp body, and is provided with a through hole, the through hole includes a first hole part and a second hole part connected with the first hole part, an inner diameter of the second hole part is greater than an inner diameter of the first hole part, and a center line of the first hole part is coincident with a center line of the first lamp body.

Further, the through hole is in a shape of figure-of-8, and the first hole part is a spherical hole.

Further, the connecting element includes a first connecting part and a pressing plate part which extends from one end of the first connecting part towards a periphery of the first connecting part, a bottom of the first connecting part is provided with a spherical hole, and the spherical hole is combined with the first hole part to form a fixing groove.

Further, a top of the second lamp body is connected with a spherical connecting part matched with the fixing groove, through a connecting rod.

Further, the connecting element is locked onto the mounting part by a screw, and the connecting element is provided with a through hole through which a conductive wire passes.

Further, the second lamp body includes a lamp-body side wall, a partition plate disposed in the lamp-body side wall and a second connecting part configured to connect the partition plate with the connecting element, the second connecting part is located in the fixing groove and is rotatable, a receiving groove is delimited by an inner surface of the lamp-body side wall and a lower surface of the partition plate, and the light source component is located in the receiving groove.

Further, a boss is disposed in a middle part of an upper surface of the partition plate, a groove is formed between the boss and the lamp-body side wall, a transparent protection cover is disposed in the groove, and the second connecting part is connected with the boss through a connecting rod.

Further, the second connecting part is spherical, and is rotatably located in the fixing groove.

Further, the partition plate is provided with several through holes penetrating an upper surface and a lower surface of the partition plate, each of the several through holes is communicated with the groove, and is configured to allow a part of the light emitted from the light source component to pass there-through.

Further, the light source component includes a light source substrate as well as several first light-emitting units and several second light-emitting units disposed on two surfaces of the light source substrate respectively, the several first light-emitting units emit light towards the first light distribution element, and the several second light-emitting units emit light towards the second light distribution element.

Further, the first light distribution element is a reflector, and the second light distribution element is a collimating lens.

Further, a position where the first lamp body is connected with the second lamp body is located in a middle part of the reflector, and a bottom of the reflector is located between a bottom of the first lamp body and the position where the first lamp body is connected with the second lamp body.

Further, the driving power supply component includes a power supply substrate which is electrically connected with the light source substrate.

Further, the power supply substrate is further provided with a controller, the controller includes a timer, a switch configured to control an on-off of the several first light-emitting units and the several second light-emitting units respectively, and a signal receiver configured to receive a signal from a remote controller or a control terminal.

Further, the illumination device further includes a clamp spring disposed at two sides of the first lamp body, respectively.

Compared with the other designs, in the illumination device of the present disclosure, a first light distribution element and a second light distribution element perform a light distribution to light emitted from a light source component, so that the illumination device may realize different illumination effects. A second lamp body is connected with a first lamp body by a connecting element, and is rotatable with respect to the first lamp body. In mounting and using, the second lamp body may be rotated according to illumination requirements, thereby adjusting the illuminating angle.

The present disclosure provides a method of manufacturing an illumination device. The method may include providing a first lamp body; providing a driving power supply component received in the first lamp body; assembling a connecting element into the first lamp body; connecting a second lamp body to the connecting element that is rotatable with respect to the first lamp body; providing a light source component received in the second lamp body; providing a second light distribution element received in the second lamp body that is configured to perform a secondary light distribution to a part of light emitted from the light source component; and disposing a first light distribution element on the first lamp body that is configured to perform a secondary light distribution to a second part of the light emitted from the light source component.

The method may also include disposing a mounting part inside the first lamp body, and providing a through hole, where the through hole may include a first hole part and a second hole part connected with the first hole part, an inner diameter of the second hole part is greater than an inner diameter of the first hole part, and a center line of the first hole part is coincident with a center line of the first lamp body.

In the method, the through hole may be in a shape of figure-of-8 as shown in FIG. 5, and the first hole part may be a spherical hole.

The method may include providing a first connecting part of the connecting element and a pressing plate part of the connecting element where the pressing plate part may extend from one end of the first connecting part towards a periphery of the first connecting part, and providing a spherical hole for a bottom of the first connecting part, where the spherical hole may be combined with the first hole part to form a fixing groove.

The method may include locking the connecting element onto the mounting part by a screw, and providing a through hole for the connecting element where a conductive wire may pass through the through hole.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The objects, technical solutions and beneficial effects of the present disclosure have been further explained particularly in the examples above. It should be appreciated that, what are described above are merely examples of the present disclosure but are not limitative to the present disclosure. Any modifications, equivalents and variations within the spirit and principle of the present disclosure shall fall within the protection scope of the present disclosure.

What is claimed is:

1. An illumination device, comprising:

a first lamp body;

a driving power supply component received in the first lamp body;

a connecting element assembled into the first lamp body, wherein the connecting element comprises a first connecting part;

a second lamp body connected to the connecting element that is rotatable with respect to the first lamp body, wherein the second lamp body comprises a second connecting part that is configured to connect the second lamp body with the connecting element, and the second connecting part is rotatable in a fixing groove disposed at a bottom of the first connecting part;

a light source component received in the second lamp body;

a second light distribution element received in the second lamp body that is configured to perform a secondary light distribution to a part of light emitted from the light source component;

a first light distribution element disposed on the first lamp body that is configured to perform a secondary light distribution to a second part of the light emitted from the light source component; and a mounting part disposed inside the first lamp body, wherein the mounting part is provided with a first hole part connected with a second hole part, and an inner diameter of the second hole part is greater than an inner diameter of the first hole part.

2. The illumination device according to claim 1, wherein:

the second lamp body comprises a lamp-body side wall, a partition plate disposed in the lamp-body side wall and the second connecting part that is configured to connect the partition plate with the connecting element, a receiving groove is delimited by an inner surface of the lamp-body side wall and a lower surface of the partition plate, and the light source component is located in the receiving groove.

3. The illumination device according to claim 2, wherein:

a boss is disposed in a middle part of an upper surface of the partition plate, a groove is formed between the boss and the lamp-body side wall, a transparent protection cover is disposed in the groove, and the second connecting part is connected with the boss through a connecting rod.

4. The illumination device according to claim 3, wherein:

the partition plate is provided with several through holes penetrating an upper surface and a lower surface of the partition plate, each of the several through holes is communicated with the groove, and is configured to allow a part of the light emitted from the light source component to pass through.

5. The illumination device according to claim 1, wherein:

the light source component comprises a light source substrate and several first light-emitting units and several second light-emitting units disposed on two surfaces of the light source substrate, and the several first light-emitting units emit light towards the first light distribution element, and the several second light-emitting units emit light towards the second light distribution element.

6. The illumination device according to claim 5, wherein the driving power supply component comprises a power supply substrate which is electrically connected with the light source substrate.

7. The illumination device according to claim 6, wherein:

the power supply substrate is further provided with a controller, and the controller comprises a timer, a switch configured to control an on-off of the several first light-emitting units and the several second light-emitting units, and a signal receiver configured to receive a signal from a remote controller or a control terminal.

8. The illumination device according to claim 1, wherein:

the mounting part is provided with a through hole, the through hole comprises the first hole part and the second hole part connected with the first hole part, and a center line of the first hole part is coincident with a center line of the first lamp body;

the through hole is in a shape of figure-of-8, and the first hole part is a spherical hole;

the connecting element comprises the first connecting part and a pressing plate part which extends from one end of the first connecting part towards a periphery of the first connecting part;

the bottom of the first connecting part is provided with a spherical hole, and the spherical hole is combined with the first hole part to form the fixing groove; and the second lamp body comprises the second connecting part that is configured to connect the second lamp body with the connecting element, the second connecting part is located in the fixing groove and is rotatable, the second connecting part is spherical, and is rotatably located in the fixing groove.

9. The illumination device according to claim 8, wherein:

the connecting element is locked onto the mounting part by a screw, and the connecting element is provided with a through hole through which a conductive wire passes.

10. The illumination device according to claim 1, wherein:

the first light distribution element is a reflector, and the second light distribution element is a collimating lens.

11. The illumination device according to claim 10, wherein:

a position where the first lamp body is connected with the second lamp body is located in a middle part of the reflector, and a bottom of the reflector is located between a bottom of the first lamp body and the position where the first lamp body is connected with the second lamp body.

12. The illumination device according to claim 1, wherein the illumination device further comprises a clamp spring disposed at two sides of the first lamp body.

13. A method of manufacturing an illumination device, comprising:

providing a first lamp body;

providing a driving power supply component received in the first lamp body;

assembling a connecting element into the first lamp body, wherein the connecting element comprises a first connecting part;

connecting a second lamp body to the connecting element that is rotatable with respect to the first lamp body, wherein the second lamp body comprises a second connecting part that is configured to connect the second lamp body with the connecting element, and the second connecting part is rotatable in a fixing groove disposed at a bottom of the first connecting part;

providing a light source component received in the second lamp body;

providing a second light distribution element received in the second lamp body that is configured to perform a secondary light distribution to a part of light emitted from the light source component;

disposing a first light distribution element on the first lamp body that is configured to perform a secondary light distribution to a second part of the light emitted from the light source component; and disposing a mounting part inside the first lamp body, wherein the mounting part is provided with a first hole part connected with a second hole part, and an inner diameter of the second hole part is greater than an inner diameter of the first hole part.

14. The method according to claim 13, further comprising:

providing the mounting part with a through hole, wherein the through hole comprises the first hole part and the second hole part connected with the first hole part, a center line of the first hole part is coincident with a center line of the first lamp body, and the through hole is in a shape of figure-of-8, and the first hole part is a spherical hole;

providing the first connecting part of the connecting element and a pressing plate part of the connecting element wherein the pressing plate part extends from one end of the first connecting part towards a periphery of the first connecting part;

providing a spherical hole for the bottom of the first connecting part, wherein the spherical hole is combined with the first hole part to form the fixing groove; and providing the second connecting part that is configured to connect the second lamp body with the connecting element, wherein the second connecting part is located in the fixing groove and is rotatable, the second connecting part is spherical, and is rotatably located in the fixing groove.

15. The method according to claim 14, further comprising:

locking the connecting element onto the mounting part by a screw, and providing a through hole for the connecting element wherein a conductive wire passes through the through hole.

* * * * *